US005119522A

United States Patent [19]

Potts

[11] Patent Number: 5,119,522

[45] Date of Patent: Jun. 9, 1992

[54] TOOTHBRUSH AND BRACE CLEANING KIT

[76] Inventor: Flora L. Potts, 46 Crescent Ct., Camby, Ind. 46113

[21] Appl. No.: 427,581

[22] Filed: Oct. 27, 1989

[51] Int. Cl.[5] ..... A46B 17/04

[52] U.S. Cl. ..... 15/167.1; 15/167.2

[58] Field of Search ..... 15/167.1, 167.2, 106

[56] References Cited

U.S. PATENT DOCUMENTS 2,244,615 1/1940 Garcin ..... 15/167.2

FOREIGN PATENT DOCUMENTS 6500263 12/1965 Netherlands ..... 15/162.2

880 of 1886 United Kingdom ..... 15/106

196193 4/1923 United Kingdom ..... 15/106

*Primary Examiner*—Harvey C. Hornsby

*Assistant Examiner*—R. Alexander

*Attorney, Agent, or Firm*—Leon Gilden

[57] ABSTRACT

A toothbrush and brace cleaning kit is provided wherein an enlarged toothbrush head longitudinally aligned with a rearwardly extending handle includes a first bristle matrix orthogonally and fixedly mounted to a first surface of the head, wherein a second surface of the head is defined by a bifurcated, spaced parallel second surface defining a gap therebetween. The gap includes a bore construction to selectively receive one of a plurality of bristle tufts positioned below the upper bifurcated surfaces, wherein confronting spaced, parallel surfaces of the gap include aligned and confronting plural rows of flexible, planar brush elements for cleansing interiorly of an orthodontic brace assembly.

2 Claims, 4 Drawing Sheets

PRIOR ART

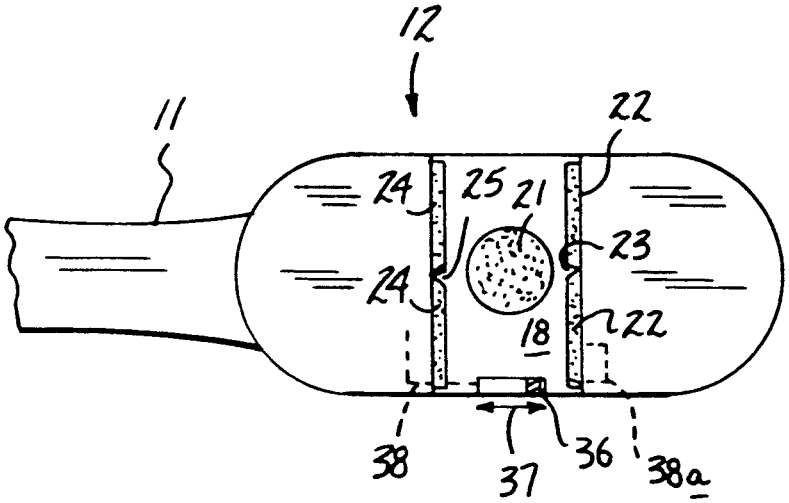
Fig 6
Fig 7
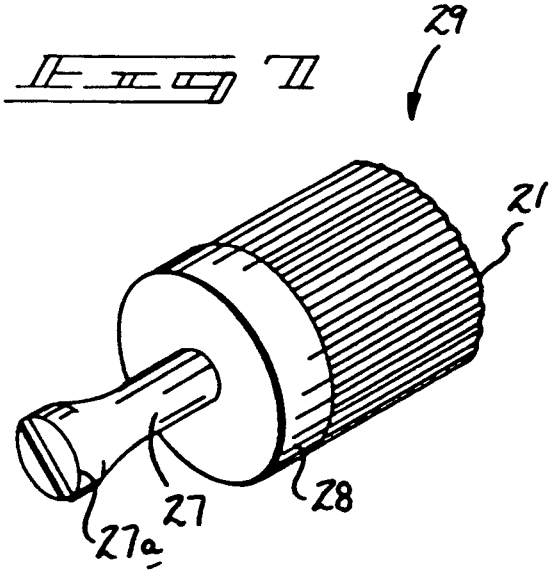

TOOTHBRUSH AND BRACE CLEANING KIT

BACKGROUND OF THE INVENTION

1. Field of the Invention

The field of invention relates to toothbrushes, and more particularly pertains to a new and improved toothbrush and brace cleaning kit wherein the same provides for selective and effective cleansing of an individual's teeth rearwardly of an assembled orthodontic brace assembly.

2. Description of the Prior Art

Tooth brush constructions of various types and configurations are well known in the prior art. Toothbrushes of the prior art have historically been developed to accommodate various needs by individuals in the cleansing of teeth. However, when individuals are wearing orthodontic braces, food particles, plaque, and debris are readily lodged between the brace and forward portions of the individual's teeth. To effectively dislodge and cleanse such portions of the teeth, great effort must be expended to effect this cleansing procedure. The prior art has heretofore failed to provide an effective and easily utilized apparatus to effect cleaning of an individual's teeth when wearing orthodontic braces. Examples of the prior art include U.S. Pat. No. 4,670,931 to Abassi illustrating a toothbrush provided with an elongate handle with a rearwardly positioned rubber tip stimulator at one end with a first major brush portion spaced from the other end with an offset upper end portion spaced remote from the stimulator tip for supporting a second smaller brush to provide access to rear molar and wisdom teeth.

U.S. Pat. No. 3,934,298 to Kim sets forth a conventionally configured toothbrush with a first bristled end containing a minor series of bristles for access to difficult portions of an individual's teeth with the other end including a major bristle end for supporting a major bristle matrix of a conventional configuration.

U.S. Pat. No. 3,337,893 to Fine illustrates a toothbrush assembly wherein a fabric plastic mesh is provided in combination with a toothbrush matrix for the enhanced scraping and cleansing of teeth.

U.S. Pat. No. 4,524,478 to Ross sets forth a toothbrush including two brush heads extending exteriorly in opposed directions from a common "S" shaped handle for the alternative cleansing of the teeth and gum areas respectively by the plurality of brush heads.

U.S. Pat. No. 4,752,984 to Moharram sets forth an elongate handle including a recessed forward end with a single row of aligned bristles for reaching behind an orthodontic brace portion, but it is provided conventional bristle configurations to attempt this maneuver, as opposed to the instant invention providing specialized planar bristles to effect a cleansing of teeth utilizing an orthodontic brace.

As such, it may be appreciated that there is a continuing need for a new and improved toothbrush and brace cleaning kit wherein the same addresses both the probems of effectiveness in construction and ease of use, and in this respect, the present invention substantially fulfills this need.

SUMMARY OF THE INVENTION

In view of the foregoing disadvantages inherent in the known types of toothbrush constructions now present in the prior art, the present invention provides a toothbrush and brace cleaning kit wherein the same utilizes planar toothbrush bristles in an aligned configuration within a gapped surface of a toothbrush head to reach between an orthodontic brace and tooth portions of an individual. As such, the general purpose of the present invention, which will be described subsequently in greater detail, is to provide a new and improved toothbrush and brace cleaning kit which has all the advantages of the prior art toothbrush apparatus and none of the disadvantages.

To attain this, the toothbrush and brace cleaning kit of the instant invention includes a toothbrush and brace cleaning kit provided with an enlarged toothbrush head longitudinally aligned with a rearwardly extending handle including a first bristle matrix orthogonally and fixedly mounted to a first surface of the head, wherein a second surface of the head is defined by a bifurcated, spaced parallel second surface defining a gap therebetween. The gap includes a bore construction to selectively receive one of a plurality of bristle tufts positioned below the upper bifurcated surfaces, wherein confronting spaced, parallel surfaces of the gap include aligned and confronting plural rows of flexible, planar brush elements for cleansing interiorly of an orthodontic brace assembly. Further it is contemplated that a switch member may be utilized to extend and retract alternative portions of the planar bristle members for improved extension and reach of such bristle members between an orthodontic brace and a forward tooth surface of an individual.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matte of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toothbrush and brace cleaning kit which has all the advantages of the prior art toothbrush apparatus and none of the disadvantages.

It is another object of the present invention to provide a new and improved toothbrush and brace cleaning kit which may be easily and efficiently manufactured and marketed.

It is a further object of the present invention to provide a new and improved toothbrush and brace cleaning kit which is of a durable and reliable construction.

An even further object of the present invention is to provide a new and improved toothbrush and brace cleaning kit which is susceptible of a low cost of manufacture with regard to both materials and labor, and which accordingly is then susceptible of low prices of sale to the consuming public, thereby making such toothbrush and brace cleaning kits economically available to the buying public.

Still yet another object of the present invention is to provide a new and improved toothbrush and brace cleaning kit which provides in the apparatuses and methods of the prior art some of the advantages thereof, while simultaneously overcoming some of the disadvantages normally associated therewith.

Still another object of the present invention is to provide a new and improved toothbrush and brace cleaning kit wherein the same provides opposed rows of planar bristle assemblies to effectively reach into and cleanse portions of forward tooth surfaces of an individual positioned behind an orthodontic brace.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a top orthographic plan view of the instant invention.

FIG. 7 is an isometric illustration of a first replaceable bristle assembly.

DESCRIPTION OF THE PREFERRED EMBODIMENT

Figure 1:
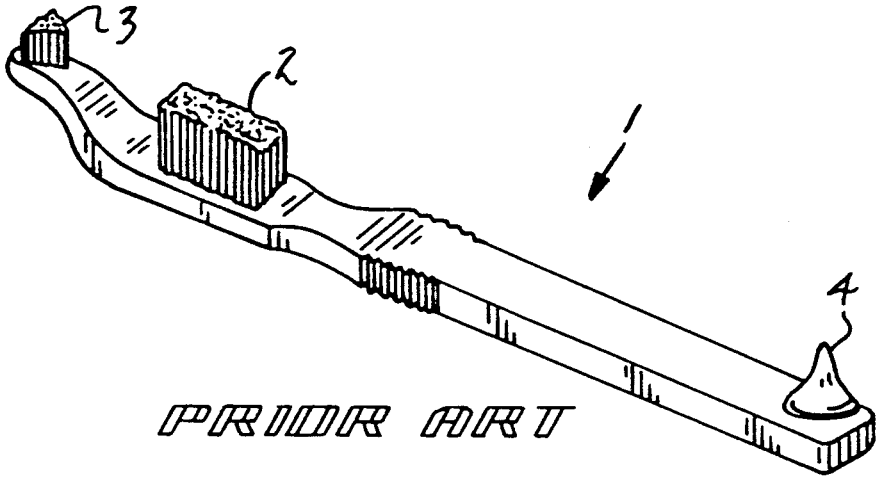
FIG. 1 is an isometric illustration of a first prior art toothbrush assembly.

With reference now to the drawings, and in particular to FIGS. 1 to 11 thereof, a new and improved toothbrush and brace cleaning kit embodying the principles and concepts of the present invention and generally designated by the reference numeral 10 will be described.

Figure 2:
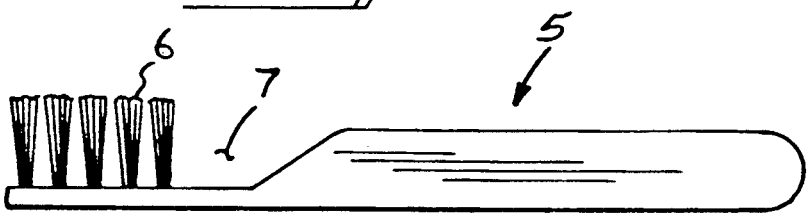
PRIOR ART Fig 2
FIG. 2 is an orthographic side view taken in elevation of a prior toothbrush assembly.
Figure 3:
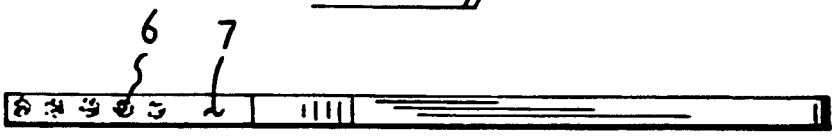
PRIOR ART Fig 3
FIG. 3 is a top orthographic view of the prior toothbrush assmbly as illustrated in FIG. 2.

More specifically, the toothbrush and brace cleaning kit 10 defines an improvement over the prior art, as illustrated in FIGS. 1, 2, and 3. The prior art toothbrush 1 includes an elongate handle defining a first major bristle matrix positioned adjacent a forward end of the handle with a second minor bristle matrix positioned at an upwardly oriented portion of the handle at the forward terminal end of the handle for access to rear molars and the like of an individual, with a gum stimulant tip 4 directed orthogonally upwardly of a remote terminal end of the handle spaced from the minor bristle matrix assembly 3. FIG. 2 illustrates a prior art toothbrush assembly 5 for cleansing interiorly of an orthodontic brace wherein a relatively thin handle is provided with an aligned row of bristles of relatively spaced construction for access interiorly of an orthodontic brace assembly positioned within a recessed portion 7 of the handle.

Figure 4:
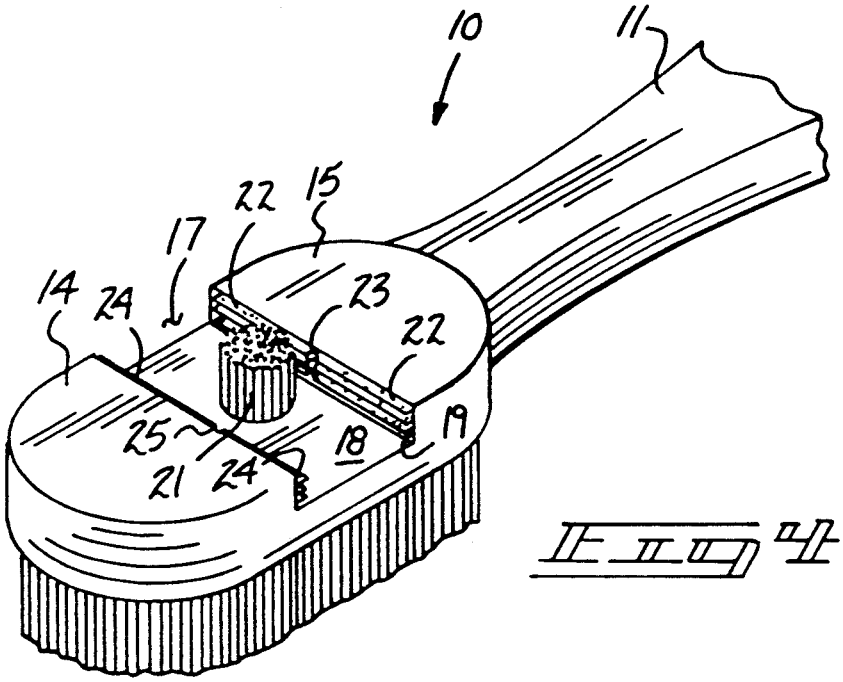
FIG. 4 is an isometric illustration of the instant invention.
Figure 5:
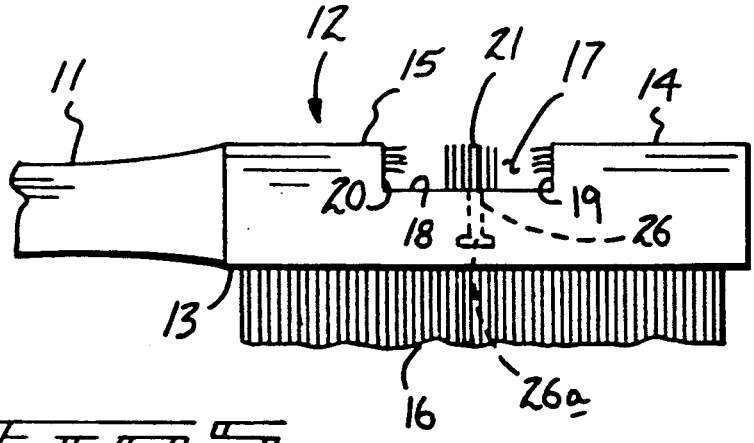
FIG. 5 is an orthographic side view taken in elevation of the instant invention.

The toothbrush and brace cleaning kit includes an elongate, longitudinally aligned handle 11 of conventional dimensional configuration formed with an enlarged head member 12 aligned with the handle 11 and integrally mounted to a forward terminal end of the handle 11, as illustrated in FIG. 4. The head member 12 includes a first head surface 13 spaced from and parallel to second and third head surfaces 14 and 15 that are in turn aligned relative to one another, as illustrated in FIG. 3, defining a recess 17 therebetween. The first head surface 13 includes a first surface bristle matrix 16 extending orthogonally relative to the first surface 13 and generally coextensive therewith for the cleansing and brushing of teeth in a conventional manner. The aforenoted recess 17 is defined by a planar floor 18 parallel to the first, second, and third head surfaces 13, 14, and 15 and spaced below the second and third aligned head surfaces 14 and 15 with confronting first and second side walls 19 and 20 arranged orthogonally relative to the floor 18 and the second and third head surfaces 14 and 15. The planar floor 18 includes a central bristle tuft 21 that is selectively and removably mounted and arranged orthogonally relative to the floor 18. The bristle tuft 21 is secured within a stem bore 26 that further includes a lower flared bore **26*a* coaxially aligned with the stem bore 26**, to be discussed in more detail below.

Directed orthogonally and outwardly of the respective first and second side walls 19 and 20 are plural rows of planar bristles 22 and 24. The bristles 22 and 24 are of a flexible, planar configuration and include spaced aligned rows aligned and orthogonally mounted on each of the first and second side walls, wherein the plural pairs of first side wall bristles 22 are divided by a first gap 23 of a generally rectangular configuration, as illustrated in FIG. 4, wherein the second side wall bristles 24 are medially terminated by a similar rectangular gap defined by a second gap 25. The gaps 23 and 25 accommodate enhanced flexure between the plural rows of the pairs of the bristle rows 22 and 24 further enable debris to be directed through the respective first and second gaps 23 and 25 for enhanced removal during a brushing procedure.

It is understood that during a brushing procedure, the central bristle tuft 21 in a confronting relationship relative to a tooth surface where an orthodontic brace is mounted will provide flexure and brushing of the tooth surface with a limited but effective brushing behind the associated brace network, wherein the rows of planar bristles 22 and 24 may be utilized and directed downwardly or upwardly relative to the brace network between the tooth surface and the brace to further brush and direct debris therefrom.

The aforenoted stem bore 26 and its axially aligned lower terminal flared bore 26*a* accommodates a central stem 27 orthogonally mounted to a bristle support base 28 of the aforenoted bristle tuft 21. The lowermost end of the stem 27 includes a bifurcated stem end portion 27*a* received within the lower flared bore 26*a* to secure the first replaceable bristle tuft assembly 29 therewithin, as illustrated in FIGS. 6 and 7 for example.

Figure 8:
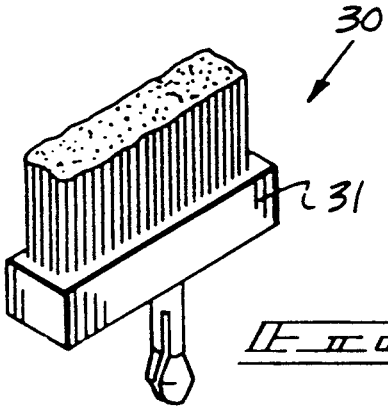
FIG. 8 is an isometric illustration of a second replaceable bristle assmbly.
Figure 9:
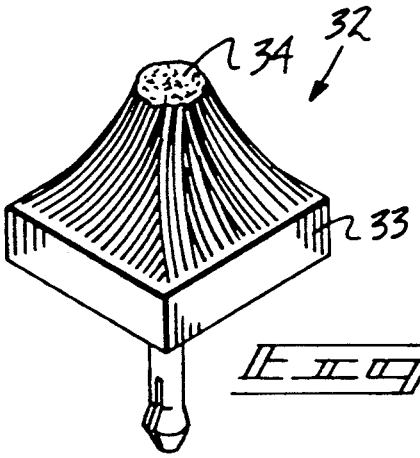
FIG. 9 is an isometric illustration of a third replaceable bristle assembly.

During a cleansing operation and due to the various geometry and configurations of a variety of tooth surfaces, various replaceable bristle tufts are desired in use. Accordingly, a second replaceable bristle tuft 30 is illustrated in FIG. 8 utilizing a rectangular bristle support base 31 with a rectangular bristle matrix directed orthogonally and upwardly thereof.

Figure 10:
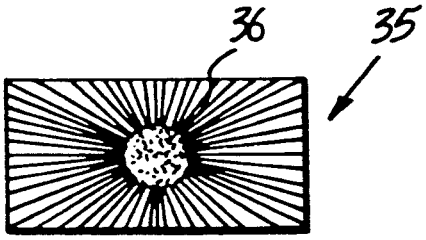
FIG. 10 is a top orthographic view of a fourth replaceable bristle assembly.
Figure 11:
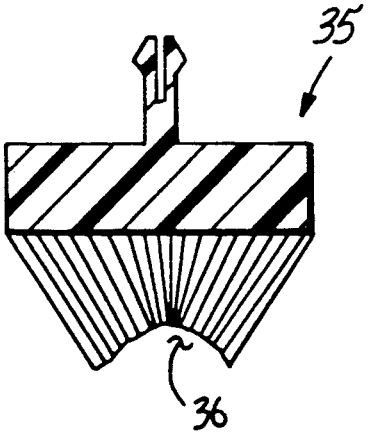
FIG. 11 is an orthographic view taken in elevation of the bristle assmbly of FIG. 10.

A third replacement bristle tuft 32 is of a generally rectangular configuration with a rectangular base 33 utilizing a square bristle matrix 34 extending upwardly and terminating in a circular upper end to enhance the rigidity and effectiveness of the upper end surface 34 in application against a surface. FIGS. 10 and 11 illustrate rectangular base defining a fourth replacement bristle tuft assembly with a rectangular base with a rectangular matrix of bristles extending upwardly and terminating in a semi-cylindrical recessed upper end to enable flexure about a brace network in use to direct the upper ends of the bristles about the braces in concert with the aforenoted planar bristles 22 and 24.

It is contemplated that the confronting planar bristles 22 and 24 may be extended and retracted to vary their effective length wherein a simple switch member 36 is reciprocatably mounted through the floor 18 in the direction of the arrows 37, wherein use of simple linkage 38 and 38*a* directed rearwardly to support surfaces of the respective bristle pairs 22 and 24 may reciprocate the bristle pairs 22 and 24 orthogonally relative to the aforenoted first and second side walls 19 and 20.

It is understood that the various replaceable bristle tuft assemblies set forth as 29, 30, 32, and 34 utilize bristle matrix whose upper terminal ends do not extend beyond or above the surfaces 14 and 15 to confine the cleansing procedures within the recess 17. Further it is understood that the aforenoted replaceable bristle tuft assemblies may be completely removed during a cleansing procedure between a tooth surface and brace assembly should an individual desire utilizing the planar bristles alone.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1.A toothbrush kit assembly for enhanced cleaning between a tooth surface and a brace assembly comprising, in combination, an elongate, longitudinally aligned handle with an elongate head member aligned with said handle;

said head member including a first planar surface with a first brush matrix orthogonally and coextensively mounted to the first planar surface, and a second planar surface and a third planar surface spaced from the first planar surface and defining a recess therebetween the second and third planar surfaces, and brush means mounted within said recess for effecting a brushing between the tooth surface and the brace assembly, and wherein the second planar surface and third planar surface are each parallel to the first planar surface and are each aligned relative to one another, and wherein the recess includes a planar floor, the planar floor being spaced below the second and third planar surfaces and parallel to the second and third planar surfaces, and the recess further including a first side wall and a second side wall wherein the first and second side wall are spaced parallel relative to one another and wherein the first side wall is orthogonally aligned relative to the floor and an elongate edge of the first planar surface, and the second side wall is spaced orthogonally relative to the floor and to a forward edge of the second planar surface, wherein the first side wall and second side wall are of equal configuration, and wherein the brush means includes a central bristle tuft arranged medially and orthogonally relative to the floor, and wherein the brush means further includes plural rows of first side wall bristles integrally and fixedly mounted to the first side wall wherein adjacent rows of side wall bristles are aligned relative to one another and include a "V" shaped gap spaced therebetween, the first side wall bristles are of a planar flexible configuration, and plural rows of second side wall bristles orthogonally and integrally mounted to the second side wall wherein adjacent side wall bristles are spaced by a "V" shaped gap, and the second side wall bristles are of a flexible and planar configuration.

2. A toothbrush kit assembly as set forth in claim 1 wherein the central bristle tuft includes a stem, the stem including a bifurcated lower terminal end, and the floor including a first bore and a second bore formed at a lower terminal end of the first bore, the second bore defined by a second bore diameter greater than a first bore diameter defined by the first bore for receiving the bifurcated lower end of the stem.

* * * * *